US005624095A

United States Patent [19]

Zissu

[11] Patent Number: 5,624,095

[45] Date of Patent: Apr. 29, 1997

[54] RESILIENT SUPPORT CADDY

[76] Inventor: Diane M. Zissu, 5 Fox Chase Dr., Watchung, N.J. 07060

[21] Appl. No.: 524,110

[22] Filed: Aug. 22, 1995

Related U.S. Application Data

[63] Continuation of Ser. No. 89,836, Jul. 12, 1993, abandoned.

[51] Int. Cl.[6] ..... A47B 96/06

[52] U.S. Cl. ..... 248/231.81; 248/300; 248/316.7

[58] Field of Search ..... 248/215, 231.81, 248/231.85, 316.7, 300, 301

[56] References Cited

U.S. PATENT DOCUMENTS

| | | | |
|---|---|---|---|
| D. 326,173 | 5/1992 | Newbold . | |
| D. 332,854 | 1/1993 | Waterston et al. . | |
| 412,499 | 9/1889 | Hamilton . | |
| 942,366 | 12/1909 | Deeter | 248/229 |
| 1,567,618 | 12/1925 | Robinson . | |
| 1,584,543 | 5/1926 | Jenks et al. . | |
| 1,705,898 | 3/1929 | Cannon et al. | 248/231.8 X |
| 1,744,196 | 1/1930 | Ames | 24/336 X |
| 1,888,127 | 11/1932 | Hearne . | |
| 2,306,174 | 12/1942 | Mallory | 248/229 |
| 2,770,411 | 11/1956 | MacKay . | |
| 2,980,281 | 4/1961 | Stewart . | |
| 3,193,229 | 7/1965 | Stock | 248/229 X |
| 4,351,505 | 9/1982 | Wickersham | 248/316.7 |
| 4,867,402 | 9/1989 | Benson et al. . | |
| 5,082,225 | 1/1992 | Nespoli | 248/231.8 |

*Primary Examiner*—Alvin C. Chin-Shue
*Assistant Examiner*—Derek J. Berger

[57] ABSTRACT

A single sheet of thermoplastic material is formed into a first clamping channel having an inclined outer wall which resiliently rotates for clamping the caddy to an edge of a structure. A second clamp is attached to the first clamp and includes a channel formed by one wall of the first clamp, a bottom wall resiliently secured to the one wall and a second wall inclined toward the one wall and resiliently upstanding from the bottom wall for accommodating articles of different outer dimensions and clamping the articles to the caddy regardless of those outer dimensions.

3 Claims, 3 Drawing Sheets

RESILIENT SUPPORT CADDY

This is a continuation of U.S. application Ser. No. 08/089,836 filed Jul. 12, 1993, now abandoned.

This invention relates to caddy devices for releasably securing the same to a table or the like or temporary storage containers for use with the table.

BACKGROUND OF THE INVENTION

Caddy devices are in wide use. Typically caddy devices comprise receptacles for waste or specific items such as household cleansers, paper towels and the like. The receptacles include a hook element at an upper edge for hooking the caddy over a cabinet door edge or similar structure. For example, U.S. Pat. No. Des. 326,173 illustrates a waste receptacle. U.S. Pat. No. Des. 332,854 shows a caddy for attachment to a waste receptacle. U.S. Pat. No. 2,980,281 illustrates a waste basket and mounting groove for attaching the basket to a desk. Other similar receptacles are known including hook structures for mounting over edges of other elements.

The present inventor recognizes a need for a caddy to releasably hold in a convenient way and location containers of miscellaneous contents that are so frequently used. Such containers take a wide variety of shapes and sizes and do not fit a general shape classification. Most often, such containers are not accessable at the time of need due to the fact that they take up necessary surface space, requiring them to be stored elsewhere. For example, baby wipe containers are used in conjunction with a baby changing table. The table is used for many purposes requiring maximum available space. However, such tables have only limited space available and do not provide any accommodations for items such as baby wipes that are so often required. Thus the baby wipe containers are often stored out of the way on a lower shelf when not in use. When needed, the containers must be retrieved, which is inconvenient. A further problem is in handling babies. One hand is needed to hold the baby, which leaves only one hand free to manipulate the container. Often, two hands are needed for such manipulation. Thus a caddy that can store and releasably hold such containers in a convenient location would be highly desirable.

SUMMARY OF THE INVENTION

A caddy for releasably holding articles having varied outer dimensions according to the present invention comprises a first clamp member for clamping the caddy to an edge of a support and a second clamp member secured to the first clamp member for resiliently securing the articles of varied outer dimensions thereto, the caddy preferably comprising a single sheet of formed thermoplastic material.

A caddy according to an embodiment of the present invention comprises first and second side walls upstanding from a first bottom wall forming a first channel, the bottom wall being resiliently hinged to the first side wall along a first interface edge therebetween for rotation relative to that first side wall about the interface edge. The second side wall is resiliently hinged to the bottom wall along a second interface edge for rotation relative to the bottom wall about the second interface edge, the first and second side walls each having an edge opposite the respective first and second interface edges thereof, the second side wall being inclined toward the first side wall so the opposite edges are closer than the interface edges and selectively resiliently spread apart in response to a spreading force. By way of example, containers of different sizes and shapes can be inserted into and held by the first channel.

A second bottom wall extends transversely from the first side wall at the first side wall opposite edge. A third side wall depends from and is resiliently rotatably hinged to the second bottom wall spaced from and inclined toward the first side wall forming a second channel inverted relative to the first channel. The second channel for example can resiliently releasably hook the caddy to an edge of a table which can have a varied edge thickness.

IN THE DRAWING

DESCRIPTION OF THE PREFERRED EMBODIMENT

Figure 1:
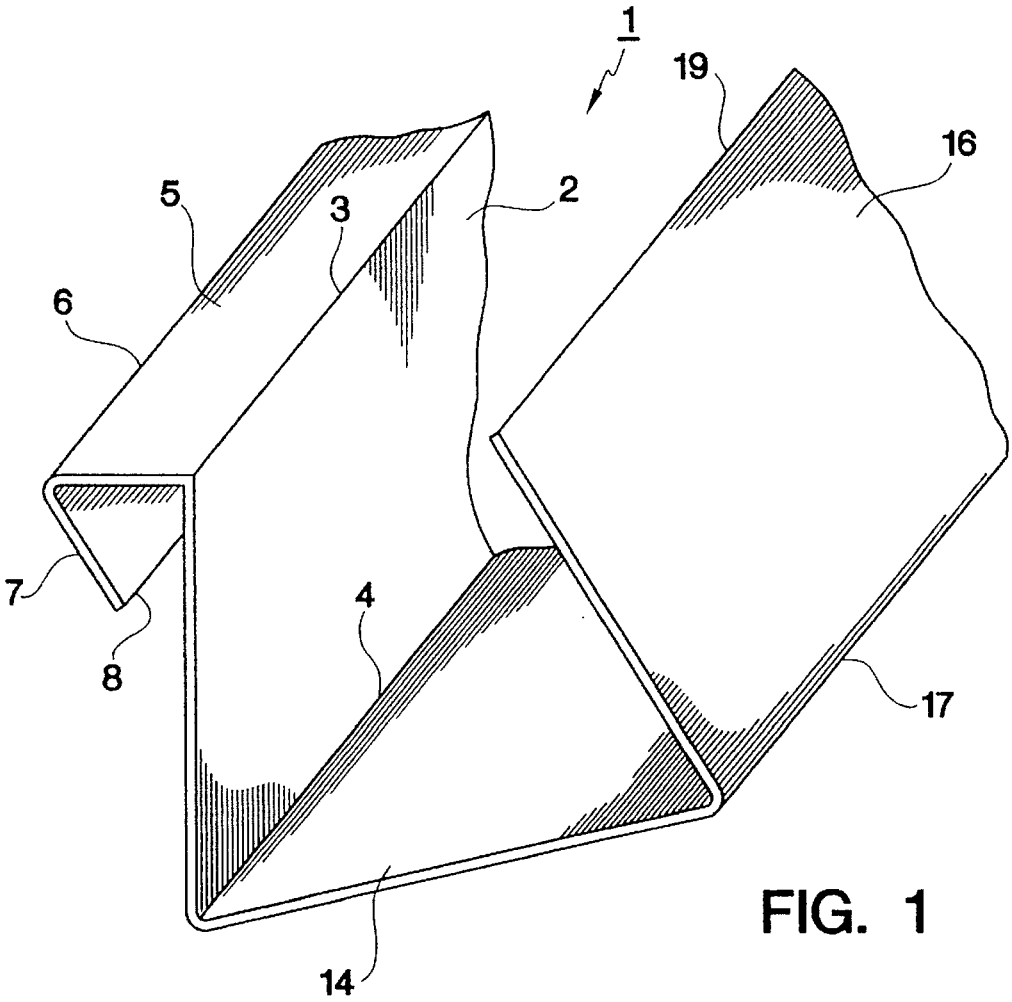
FIG. 1 is an isometric view of a caddy according to an embodiment of the present invention.
Figure 5:
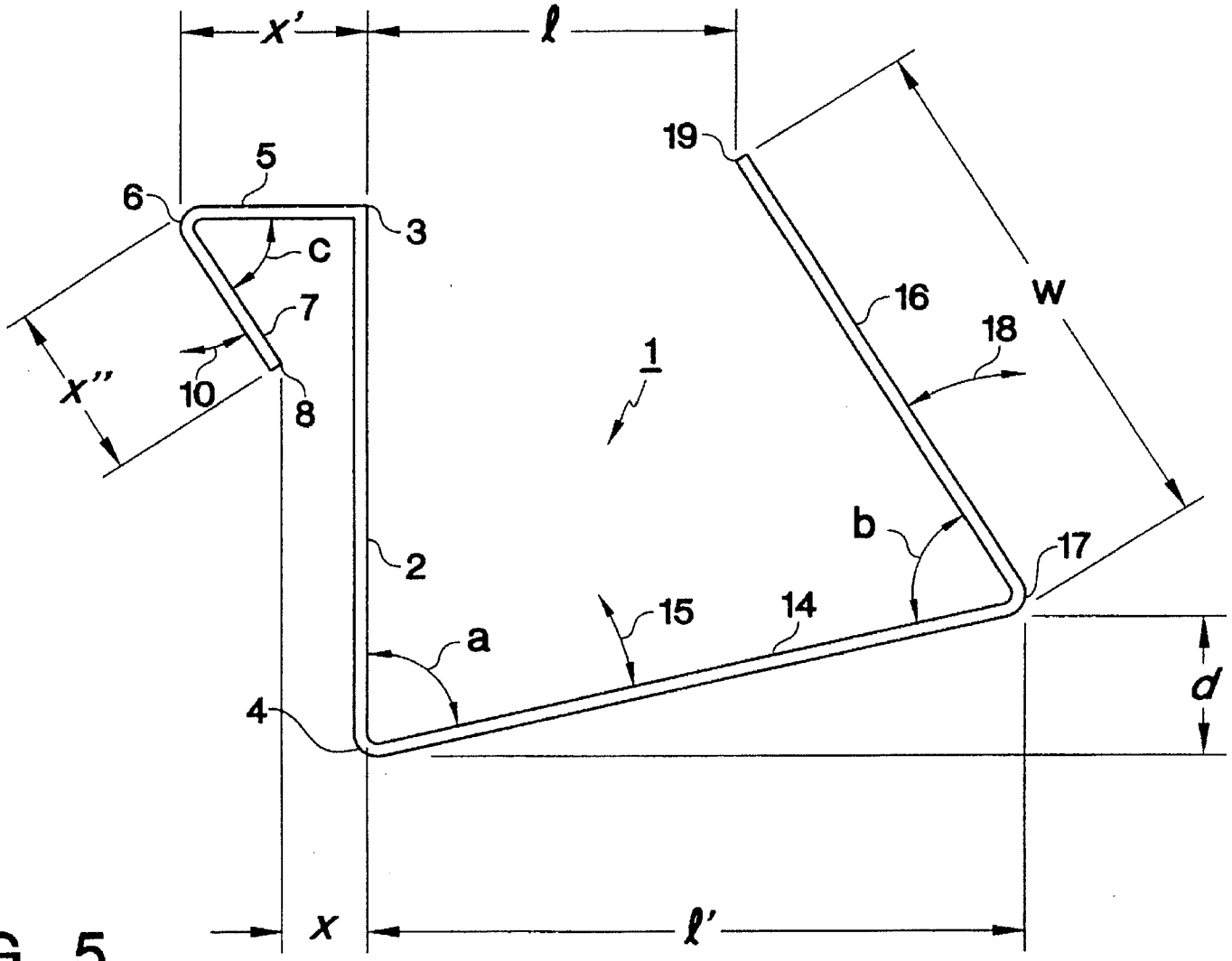
FIG. 5 is an end elevational view of the caddy of FIG. 1 to illustrate certain principles of the present invention.

In FIGS. 1 and 5, caddy 1 is formed from an integral single sheet of formed thermoplastic and may be molded or formed to the shape shown. The caddy 1 comprises an elongated rectangular planar side wall 2 having upper and lower edges 3 and 4, respectively. A transverse rectangular planar wall 5 extends from the edge 3 normal to the wall 2. The wall 5 terminates at distal edge 3 in an edge 6 parallel to edge 3. A rectangular planar wall 7 depends from the edge 6 at an acute angle relative to the wall 5 and terminates at an edge 8. The wall 7 inclines toward the wall 2 at an acute angle "c" so that the edge 8 is closer to the wall 2 than the edge 6. The edge has a gradual radius sufficient so that the wall 7 can resiliently rotate relative to the wall 5 in directions 10, see FIG. 5. The radius at the edge 6 forms a hinge so to permit the relative rotation of the walls 5 and 7. In this way, the wall 7 can be resiliently spread apart from wall the 2 to accommodate a structure edge 12, see FIG. 2, so the caddy 1 can be releasably secured over the structure edge 12. The wall 7 clamps the edge 12 to the wall 2.

A planar rectangular wall 14, see FIGS. 1 and 5, extends from the lower edge 4. The lower edge 4 also has a gradual radius to permit the wall 14 to flex relative to the wall 2 about the edge 4 in directions 15, see FIG. 5. The wall 14 is at an acute angle "a" with respect to the wall 2. A planar rectangular wall 16 extends from the edge 17 of the wall 14 distal and parallel to the edge 4. The edge 17 also has a gradual radius to permit the wall 16 to flex relative to the wall 14 in directions 18. The wall 16 is at an acute angle "b" with respect to the wall 14. The upper edge 19 of the wall 16 is closer to the wall 2 than the lower edge 17. The wall 16 can be spread apart from the wall 2 in directions 18 to accommodate articles of different sizes.

In FIG. 5, various dimensions will now be given by way of example. The walls 2, 5, 7, 14 and 16 are all preferably the same thickness and may be ⅛ inch thick thermoplastic sheet material molded from a single sheet. The wall 5 may have a width x' of about 1¼ inches whereas the wall 7 may have a width x" of about 1 inch. The edge 8 may be spaced from the wall 2 about ½ inches. The wall 14 may have a width 1' of about 5 inches and angle "a" may be about 60°–80°. Angle "b" may also be about the same as angle "a". These angles are not critical. The wall 16 may have a width w of about 3 inches. The spacing of the upper edge 19 from the wall 2 distance 1 may be about 3 to 4 inches.

Figure 2:
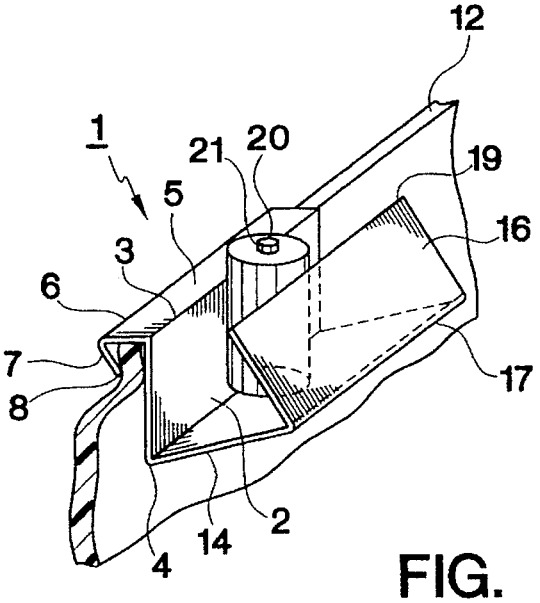
FIGS. 2 and 3 and 4 are respective isometric and side elevation views illustrating different size containers being held by the caddy of FIG. 1.

Because of the angle "a", the wall 14 slopes upward toward the wall 2 and also flexes relative to the wall 2 to assist the wall 16 in grasping an article held in the channel between the walls 2, 14 and 16. In FIG. 2, a small bottle 20 is shown held in place by the walls 2, 14 and 16. The bottle is light and does not cause the wall 14 to bend about the lower edge 4. The structure edge 12 spreads the wall 7 from the wall 2 which resiliently clamps to the structure edge 12. The bottle 20 is firmly held in place so that the cap 21 can be removed with one hand.

Figure 3:
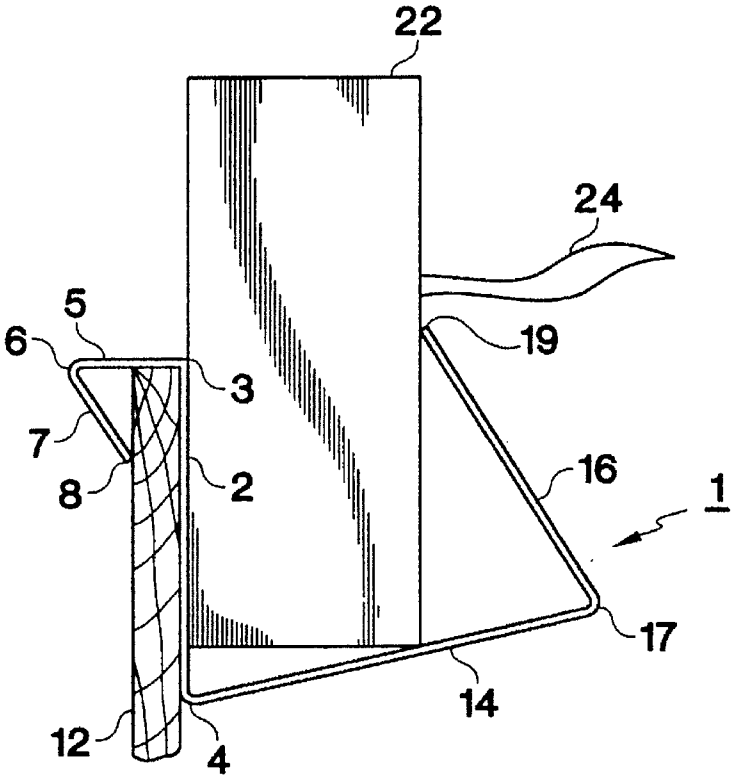

In FIG. 3, the caddy 1 holds a tissue box 22 for dispensing tissues 24. The edge 19 firmly but resiliently clamps the box 22 to the wall 2 so that tissues can be dispensed from the box 22 with one hand. The wall 7 firmly clamps the caddy 1 to the structure edge 12.

Figure 4:
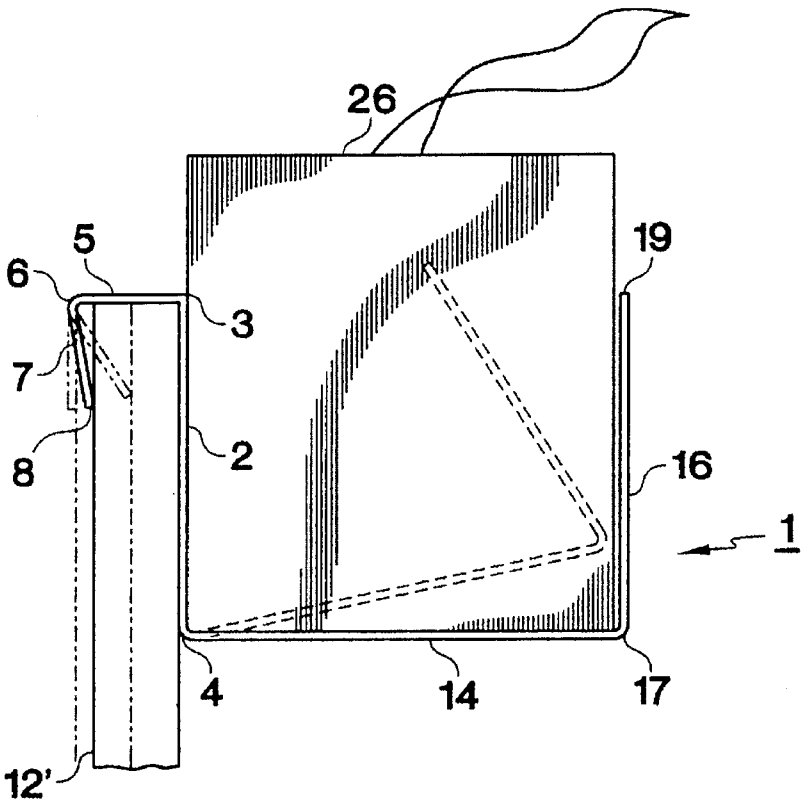

In FIG. 4, the caddy 1 supports a relatively heavier box 26, siuch as a box of diaper wipes. Here the structure edge 12' is thicker than in the other embodiments and is accommodated by the resilient wall 7 mounted to the wall 5. The box 26 flexes the bottom wall 14 about the lower edge 4 relative to the wall 2 and provides firm support for the heavier article. The flexing of the wall 14 and the wall 16 provide increased load on the article, holding it in place. The caddy 1 is shown in phantom without the article box 26 in place and in phantom to show thinner structure edges 12'. As a result a wide variety of article shapes and sizes can be firmly clamped in place to allow single hand manipulation of the article, whether it be to remove a cap or to remove a substance from the article container.

It should be appreciated that various modifications to the embodiments may be made by one of ordinary skill without deviating from the scope and spirit of the present invention as set forth in the appended claims. For example, the caddy walls as shown are planar but they may be curved or have other shapes. The caddy walls may be lined with a frictional material to aid in retaining articles in the caddy, or to ensure that bottles of fluid remain upright. The inner walls 7 and 4 for example may have ridges molded therein, also to aid in retaining articles in the caddy in a preselected position. While integral walls are illustrated, they could be separate spring hinged mounted structures if desired. The important aspect is that two channels be provided; one for clamping the caddy to a support and the other for clamping an article of differing sizes to the caddy.

What is claimed is:

1. A caddy consisting of:

a first planar wall having first and second parallel edges;

a second planar wall having a third parallel edge, said first edge connecting said first and second planar walls to form a first resilient joint about which the second wall rotates relative to the first wall, said first and second walls forming an acute angle;

a third planar wall having a fourth edge, the third edge connecting said second and third planar walls to form a second resilient joint about which the third wall rotates relative to the second wall, said second and third walls forming an acute angle;

a fourth planar all having a fifth edge, the second edge connecting said first and fourth planar walls the fourth all being approximately normal to the first wall, the second edge forming a third resilient joint about which the fourth wall rotates relative to the first wall, said first and fourth walls forming an acute angle; and a fifth planar wall having a sixth edge parallel to the fifth edge, the fifth edge connecting the fifth wall to the fourth wall to form a fourth resilient joint about which the fifth wall rotates relative to the fourth wall.

2. The caddy of claim 1 wherein said walls are of an integral single sheet of thermoplastic material.

3. A caddy according to claim 1 wherein said second and third walls are shorter than said first wall, and said fourth and fifth walls are about the same length as said first wall.

* * * * *